US007249939B2

(12) United States Patent
Yanagihara et al.

(10) Patent No.: US 7,249,939 B2
(45) Date of Patent: Jul. 31, 2007

(54) REAR CASING ARRANGEMENT FOR MAGNETIC DRIVE PUMP

(75) Inventors: Toshinori Yanagihara, Iruma (JP); Koichi Kojima, Nagareyama (JP); Yoshihiro Iba, Tokorozawa (JP)

(73) Assignee: Iwaki Co., Ltd., Chiyoda-ku, Tokyo (JP)

( * ) Notice: Subject to any disclaimer, the term of this patent is extended or adjusted under 35 U.S.C. 154(b) by 763 days.

(21) Appl. No.: 10/735,761

(22) Filed: Dec. 16, 2003

(65) Prior Publication Data

US 2004/0184936 A1 Sep. 23, 2004

(30) Foreign Application Priority Data

Mar. 20, 2003 (JP) ..... 2003-078696

(51) Int. Cl.
*F04B 39/00* (2006.01)

(52) U.S. Cl. ..... 417/420

(58) Field of Classification Search ..... 417/420, 417/423.1

See application file for complete search history.

(56) References Cited

U.S. PATENT DOCUMENTS 4,850,818 A 7/1989 Kotera
4,998,863 A * 3/1991 Klaus ..... 417/63
6,270,324 B1 * 8/2001 Sullivan et al. ..... 417/420
6,293,772 B1 * 9/2001 Brown et al. ..... 417/420
6,443,710 B1 * 9/2002 Tatsukami et al. ..... 417/365
2002/0054820 A1 * 5/2002 Fukamachi et al. ..... 417/420
2005/0019182 A1 * 1/2005 Klein et al. ..... 417/420

FOREIGN PATENT DOCUMENTS

GB 2 145 882 A 4/1985
JP 11148482 A 6/1999
JP 2002138985 A 5/2002

* cited by examiner

*Primary Examiner*—Anthony Stashick
*Assistant Examiner*—Vikansha Dwivedi
(74) *Attorney, Agent, or Firm*—Bacon & Thomas, PLLC

(57) ABSTRACT

It is sought to provide a rear casing arrangement for a magnetic drive pump, which can sufficiently provide such functions pressure resistance and heat resistance, which give rise to problems in the case of manufacturing the rear casing from a material based on a synthetic resin, and can also be manufactured at low cost.

A reinforcing belt-like ring member is woundly fitted on the outer periphery of a cylindrical barrel part of an inner casing member constituting a rear casing. The belt-like ring member has a width smaller than the length of the barrel part. A casing cover member is fitted on the belt-like ring member in the above fitted state. Alternatively, it is possible to fit the belt-like ring member on the outer periphery of a barrel part of the casing cover member. These parts can be disassembled.

6 Claims, 3 Drawing Sheets

REAR CASING ARRANGEMENT FOR MAGNETIC DRIVE PUMP

BACKGROUND OF THE INVENTION

1. Field of the Invention

This invention relates to a rear casing arrangement for a magnetic drive pump, the magnetic drive pump comprising a front casing and a rear casing defining a pump chamber together with the front casing, the rear casing being rotatable in unison with an impeller in the pump chamber and intervening between a rotor having a driven magnet and drive magnet disposed outside thereof.

2. Description of the Prior Art

The rear casing is required to have corrosion resistance as required in the case of using chemical fluid or semiconductor processing fluid as pump supply fluid and also pressure-resistant mechanical strength to resist pressure applied to the pump supply fluid in the pump operation. In addition to the pressure-resistant mechanical strength, in the case of using high-temperature reactive fluid as the pump supply fluid, heat resistance is required. Among the rear casing structures are a single layer or single member structure, in which a single member copes with the above functions, and a so-called two-layer structure, which comprises an inner casing member disposed on the side of contact with the pump supply fluid for meeting the corrosion resistance, and a cover member, which is disposed on the outer side of the inner casing member for meeting the pressure resistance, and hence the mechanical strength. Either member of this two-layer structure is required to be heat-resistant in function.

The single member structure rear casing is formed from such materials as thermoplastic resins, which can be readily injection molded as well as being corrosion-resistant, and fragile or brittle materials typically ceramics. However, the thermoplastic resins are insufficient in the pressure-resistant and heat-resistant mechanical strength. The ceramics, on the other hand, have problems that they are weak against temperature changes and also lead to high cost of manufacture, although they provide high pressure-resistant mechanical strength. As an improvement against these drawbacks, the above two-layer structure has been proposed. In an example of this structure, a thermoplastic resin which is richly corrosion-resistant and capable of being readily molded, is used for the inner casing member, and a metal cover is used as the mechanical strength cover member. However, the metal cover leads to cost increase, and also has problems of efficiency reduction due to eddy current generated in the space between the drive and driven magnets and also attaching of the inner casing member by heat generation. To cope with these problems, it has been proposed to form the mechanical strength cover member from fiber-reinforced plastics, which are composite materials obtained by combining a fibrous reinforcing material for providing for the mechanical strength and thermoplastic resin. In this case, however, the mechanical strength is inevitably reduced by temperature increase of the thermoplastic resin. A further cover member proposal has a structure obtained by combining a thermoplastic resin and a fibrous reinforcing material. This structure has an advantage that it can hold relatively stable mechanical strength irrespective of temperature changes. However, it has a problem in its manufacture that the degree of shape freedom is low, thus leading to high cost of manufacture.

At any rate, the rear casing of any of the above kinds is interposed in a narrow space between the drive magnet and a rotor having a driven magnet. Therefore, a restriction is imposed on the material thickness, and it has thus been extremely difficult to obtain a shape which is advantageous in view of the mechanical strength.

The present invention has been made in view of the above various problems, and it has an object of providing a rear casing arrangement for a magnetic drive pump, which does not use any metal subject to eddy current generation which is undesired as material, but chooses a synthetic resin material, while solving the mechanical strength problems by adding a reinforcing ring member having a cylindrical shape which can be readily manufactured, so that it can sufficiently meet each function necessary as the rear casing and also be manufactured at low cost.

SUMMARY OF THE INVENTION

To attain the above object, according to the present invention a rear casing arrangement for a magnetic drive pump is provided, which pertains as a preamble to a magnetic drive pump of a structure comprising a front casing an intake port directed in the direction along the longitudinal axis and a discharge port directed in the radial direction, a rear casing defining an inner pump chamber in cooperation with the front casing, an impeller disposed in the pump chamber, a rotor for being rotated in unison with the impeller and having a driven magnet, rotor support means for rotatably supporting the rotor, and a drive magnet disposed on the outside of the rear casing such as to face the driven magnet in the rotor via the rear casing, the rotor being rotatable in unison with the impeller by magnetic coupling between the drive and driven magnets to cause a pump supply fluid such as a chemical fluid or a semiconductor processing fluid to flow into the pump chamber from the intake port and out of the pump chamber from the discharge port for execution of the pump operation, the rear casing having a flange part mounted on the front casing and a bottom part having a front end integral with the flange part and a closed rear end part, the magnetic drive pump rear casing structure further having a reinforcing belt-like ring member woundly fitted on the outer periphery of a cylindrical barrel part of the rear casing and having a width smaller than the length of the cylindrical barrel part.

In the rear casing of this structure, with the reinforcing belt-like ring member fitted on the outer periphery of the cylindrical barrel part of the rear casing, it is possible to prevent the phenomenon of deformation or extrusion of the barrel part due to heat and/or pressure. It has been found that the cylindrical barrel part constitutes a point, at which the rear casing deformed by heat and/or pressure is led to rupture, and the invention is predicated in the fact that reinforcement of this part is most important. According to the present invention, the belt-like ring member sufficiently fulfills this role. The belt-like ring member has a further advantage that it can be easily manufactured by slicing a cylindrical structure to a predetermined width, thus providing for low cost of manufacture.

According to the present invention, another magnetic drive pump rear casing structure is provided, in which the rear casing in the above structure is formed from a synthetic resin, while the reinforcing belt-like ring member is formed from a material constituted by a combination of a thermoplastic resin and a fibrous reinforcing material.

In the rear casing of this structure, the rear casing is free from the eddy current generation problem because it is formed from the synthetic resin instead of metal, and can also be readily and inexpensively manufactured by injection molding, while the belt-like ring member is formed from a composite material which is constituted by a combination of a thermoplastic material and a fibrous reinforcing material. The belt-like ring member constituted by a combination of a thermoplastic resin, which difficultly permits molding and free shape formation, and a fibrous reinforcing material, may be of a simple ring-like shape and can be manufactured at low cost.

According to the invention, a further magnetic drive pump rear casing is provided, which pertains as a preamble to a magnetic drive pump of a structure comprising a front casing having an intake port directed in the longitudinal axis direction and a discharge port directed in the radial direction, a rear casing defining an inner pump chamber in cooperation with the front casing, an impeller disposed in the pump chamber, a rotor for being rotated in unison with the impeller and having a driven magnet, a rotor support means for rotatably supporting the rotor, and a drive magnet disposed on the outside of the rear casing such as to face the driven magnet in the rotor for rotating the rotor in unison with the impeller with magnetic coupling with the driven magnet, a pump supply fluid to cause a pump supply fluid such as a chemical fluid or a semiconductor processing fluid to flow into the pump chamber from the intake port and out of the pump chamber from the discharge port for execution of the pump operation, the rear casing has an inner casing member having a flange port mounted on the front casing, a cylindrical barrel port having a front end integral with the flange part and a closed rear end part and interposed between the rotor and the drive magnet, and a closed rear end integral with the rear end of the barrel part and to be in direct contact with the pump supply fluid in the pump chamber, and a casing cover member having a flange part, a cylindrical barrel part and a rear end part, these parts being integral with one another such as to correspond to the inner casing member, and fitted on the outer periphery thereof, the magnetic drive pump rear casing structure having a reinforcing belt-like ring member intervening between the inner casing member and the casing cover member, woundly fitted on the outer periphery of the cylindrical barrel part of the inner casing member and having a width smaller than the length of the cylindrical barrel member.

In the rear casing of the structure, with the reinforcing belt-like ring member fitted on the outer periphery of the cylindrical barrel part of the inner casing member, it is possible to prevent the phenomenon of deformation or extrusion of the barrel part due to heat and/or pressure. With the belt-like ring member disposed to intervene between the two members of the two-layer structure rear casing, a three-layer structure rear casing is obtained, which can sufficiently fulfill the functions necessary for the rear casing owing to the aggregation of the individual functions.

According to the present invention, a still further magnetic drive pump rear casing arrangement is provided, in which the above inner casing member is formed from a thermoplastic resin, the above casing cover member is formed from a thermoplastic resin or a material constituted by a combination of the thermoplastic resin and a fibrous reinforcing material added thereto, and the above reinforcing belt-like ring member is formed from a material constituted by a combination of a thermoplastic resin and a fibrous reinforcing material.

In the rear casing of this structure, the inner casing member which is to be in direct contact with the pump supply fluid can be formed from a corrosion-resistant thermoplastic resin, and the casing cover member can be formed from a richly pressure-resistant thermoplastic resin or a composite material constituted by a combination of such thermoplastic resin and reinforcing fibers for reinforcing the resin and capable of being manufactured by extrusion molding, while the belt-like ring member can be formed by using a composite material constituted by a combination of a thermoplastic resin and a fibrous reinforcing material. Since the combination of a thermoplastic resin and reinforcing fibers, which is a material difficultly permitting the molding and formation of a free shape, can be processed to obtain a simple ring-like shape, it permits manufacture at low cost.

According to the present invention, a yet further magnetic drive pump rear casing arrangement is provided, in which the above reinforcing belt-like ring member is disposed at least in a region, in which the drive magnet and the driven magnet of the rotor face each other.

With this structure, with the belt-like ring member disposed in the region, in which the driven magnet and the drive magnet are magnetically coupled together, for reinforcing the barrel part of the inner casing member, it is possible to enhance the reinforcing effect.

BRIEF DESCRIPTION OF THE DRAWINGS

The above and other objects, features and advantages of the invention will become more apparent upon reading of the following detailed description with reference to the drawings, in which.

DETAILED DESCRIPTION OF THE PREFERRED EMBODIMENTS

Figure 1:
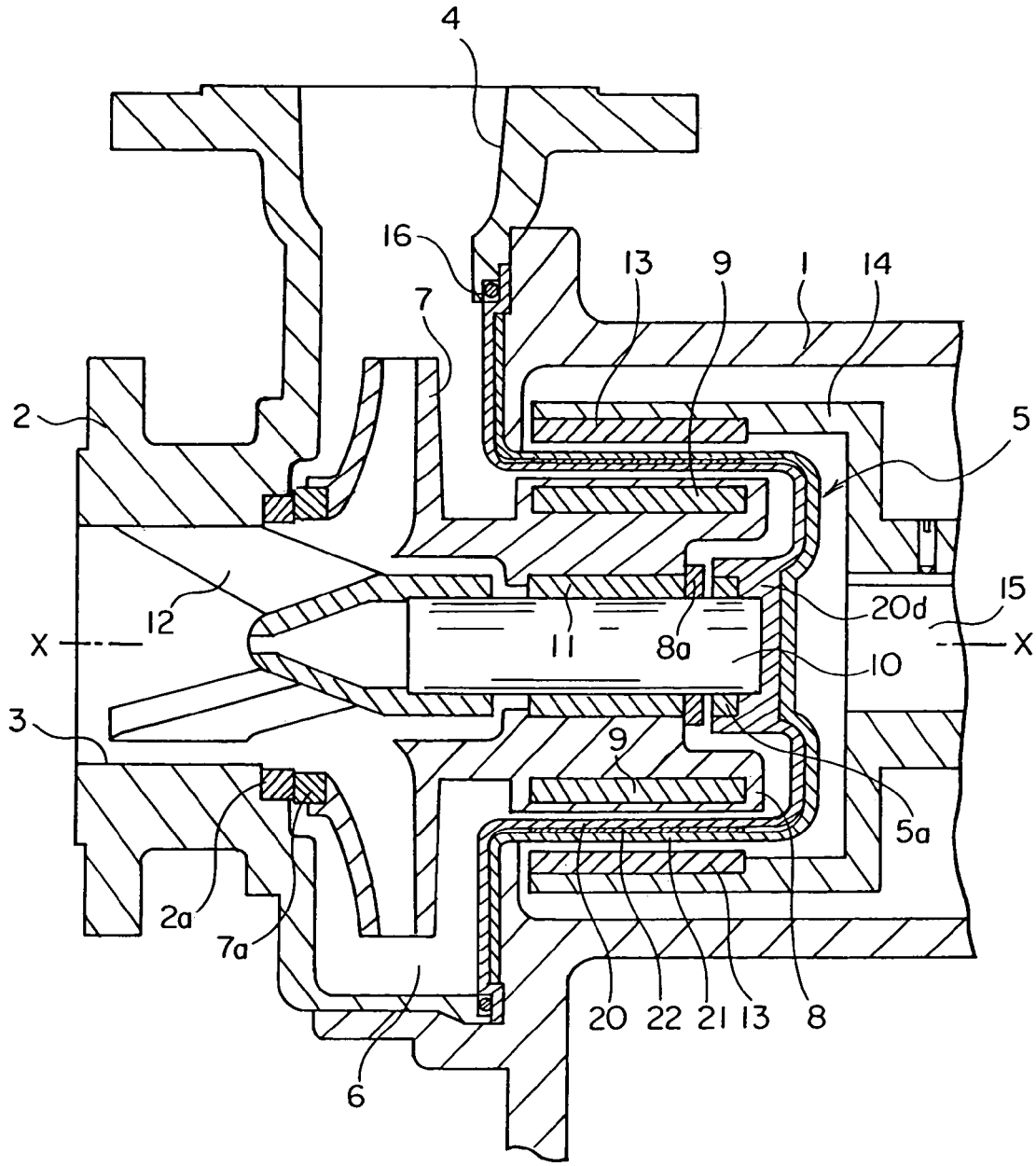
FIG. 1 is a sectional view showing a magnetic drive pump having a first embodiment of the rear casing structure according to the invention.

Now, embodiments of a rear casing arrangement for a magnetic drive pump according to the present invention will be described with reference to the drawings. FIG. 1 shows a magnetic drive pump with a first embodiment of the rear casing arrangement according to the present invention. Designated at 1 is a pump body, at 2 a front casing mounted on the pump body 1 at an end thereof and having an intake port 3 directed in the direction along the longitudinal axis X—X of the pump body 1 or the magnetic drive pump and a discharge port 4 directed in the radial direction, at 5 a synthetic resin two-layer structure rear casing defining an inner pump chamber 6 in cooperation with the front casing, at 7 an impeller disposed in the pump chamber 6, at 8 a rotor to be rotated in unison with the impeller 7 and having a driven magnet 9 in a sealed state, at 10 a spindle as a rotation support means disposed in the longitudinal axis X—X such as to rotatably support the rotor 8 via a bearing 11 and having a front end (i.e., left end in FIG. 1) secured to a front side support 12 secured to the inner periphery of the intake port 3 of the front casing 2 and a rear end (i.e., right end in FIG. 1) held in a secured state in the rear casing 5, at 13 a drive magnet disposed on the outside of the rear casing 5 such as to face the driven magnet 9 in the rotor 8 via the rear casing 5 in the radial direction, and at 14 a driver supporting the drive magnet 13 in an end part of the inner periphery and coupled via a drive shaft 15 to a drive motor (not shown) for driving the drive magnet 13 for rotation with the motor torque.

When the drive magnet 13 is driven for rotation about the longitudinal axis X—X, a pumping operation is executed such that the rotor 8 is driven for rotation in unison with the impeller 7 by the magnetic coupling of the drive and driven magnets 13 and 9 facing each other to cause the pump supply fluid to flow into the pump chamber 7 from the intake port 3 and thence through the impeller 7 to be discharged from the discharge port 4. During this time, the impeller 7 and the rotor 8 is restricted against movement in the axis X—X directions. Specifically, the forward movement is restricted by the engagement of a mouth ring 7 provided on the impeller 7 and a liner ring 2*a* provided on the front casing 2 with each other, while the rearward movement is restricted by a rear side friction ring 8*a* provided on the rotor 8 and a rear side thrust bearing 5*a* provided on the rear casing 5.

The flow path arrangement is such that during the pumping operation the pump supply fluid in the pump chamber 6 partly bypassingly flows through a space between the rear casing 5 and the rotor 8 from behind the impeller 7 into a depth region of the rear casing 5. The pump supply fluid thus always directly touches the inner periphery of the rear casing 5, and pressure and heat are directly transmitted from the fluid to the rear casing 5. An arrangement for coping with this bypassing flow is therefore necessary. This is so because particularly the space between the rotor 8 having the driven magnet 9 and the drive magnet 13 is defined to have a very small size for providing improved magnetic coupling efficiency, thus giving rise to a possibility, in the event of deformation of the intervening rear casing 5 due to the effects or pressure and/or heat, of operation failure when the rear casing 5 touches the rotor 8 or the drive magnet 13.

Figure 2:
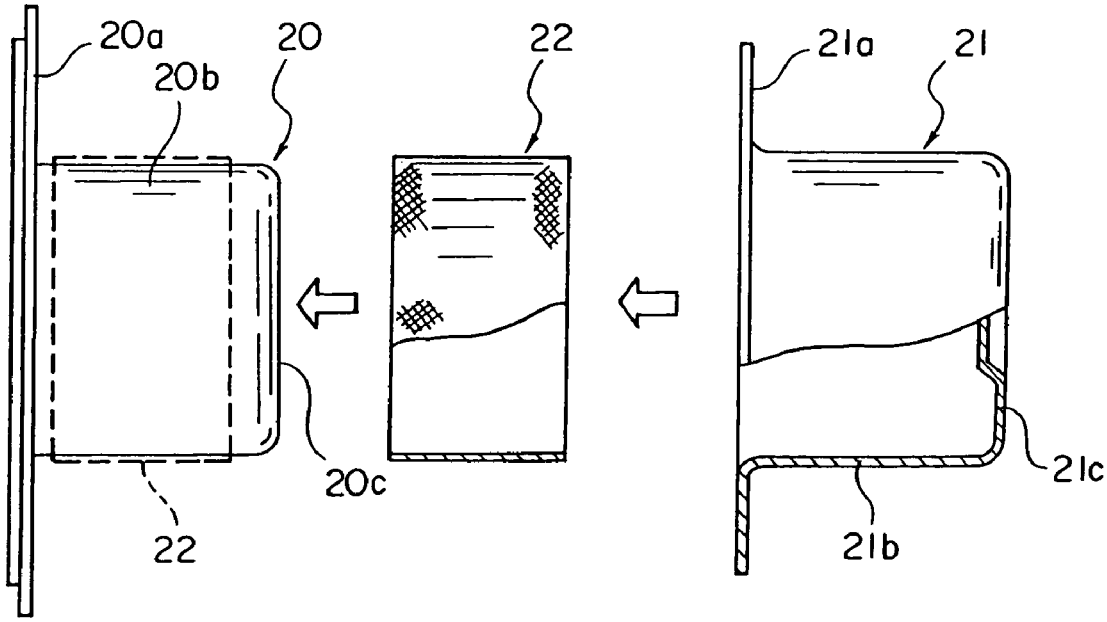
FIG. 2 is an exploded side view showing the rear casing shown in FIG. 1.

FIG. 2 shows the rear casing 5 shown in FIG. 1 according to the invention in an exploded state. Designated at 20 is the inner casing member, which has a flange part 20*a*, a cylindrical barrel part 20*b* having a front end integral with the flange part 20*a*, and a rear end part 20*c* integral with the rear end of the barrel part 20*b* and having a closed rear end. The rear end part 20*c* has an integral rear side support part 20*d* (FIG. 1) formed in an inner central part and supporting the rear end of the spindle 10. The inner casing member 20 is formed from a richly corrosion-resistant synthetic resin, for instance a thermoplastic resin such as fluorine resin, and is fabricated by injection molding. As other thermoplastic resins may be used polypropylene (PP), polyphenylene ether (PPE) and polyphenylene sulfide (PPS).

As shown in FIG. 1, the flange part 20*a* of the inner casing member 20 is secured to the front casing 2 via a seal member 16 such as an O-ring or a gasket in such a manner as to clamp the pump body 1, and the cylindrical barrel part 20*b* is disposed between the rotor 8 and the drive magnet 13.

Designated at 21 in FIG. 2 is a casing cover member having a shape corresponding to the inner casing member 20 and having a flange part 21*a*, a cylindrical barrel part 21*b* and a rear end part 21*c*, these parts being integral with one another. The casing cover member 21 constitutes the rear casing 5 together with the inner casing member 20. The flange parts 20*a* and 21*a*, the barrel parts 20*b* and 21*b*, and the rear end parts 20*c* and 21*c* constitute a flange part, barrel part and rear end part of the rear casing 5. The casing cover member 21 is formed from a synthetic resin, for instance such thermoplastic resin as polyamide (PA), PP, and PPS, or fiber-reinforced plastic material constituted by a combination of the above synthetic resin used as a base and an additional reinforcing fibrous reinforcing material, and it is fabricated as a one-piece injection molding. Thus, the casing cover member 21 which is richer in the pressure resistance than the inner casing material 20 is obtained. As shown in FIG. 1, the flange part 21*a* is secured to the front casing 2 in a state that it is overlapped over the inner casing member 20 and clamped between the front casing 2 and the pump body 1. As the fibrous reinforcing material may be used aramido fibers, typically "KEVLAR" (a trade name), carbon fibers and glass fibers.

Designated at 22 in FIG. 2 is a reinforcing belt-like ring member. As shown in FIG. 1, the reinforcing belt-like ring member is assembled such that it is woundly fitted on the outer periphery of the cylindrical barrel part 20*b* of the inner casing member 20 to suppress deformation or extrusion of the barrel part 20*b*. The belt-like ring member 22 has a width smaller than the length of the barrel part 20*b* of the inner casing member 20, and also smaller than the length of the barrel part 21*b* of the casing cover member 21. The length of the barrel part 20*b* is counted along the longitudinal axis X—X of the pump 1 or the magnetic drive pump. The belt-like ling member 22 is assembled such that it is fitted on the barrel part 20*b* and covered by the casing cover member 21, thus providing a three-layer structure rear casing as a whole.

The reinforcing belt-like ring member 22 is desirably formed as a composite structure constituted by a combination of a thermoplastic resin as a base and a fibrous reinforcing material added for reinforcement. Thus, it is possible to provide a reinforcing member which strongly immune to heat, permitting positive suppression of the deformation or extrusion of the barrel part of the inner casing member 20. As the thermoplastic resin may be used epoxy, polyester, vinyl ester, phenol, etc., and as the fibrous reinforcing material may be used aramido fibers, typically "KEVLAR" (a trade name) as noted above, carbon fibers, glass fibers, etc.

The reinforcing belt-like ring member 22 is desirably assembled on the barrel part 20*b* of the inner casing member 20 between both the inner casing member 20 and the casing cover member 21 as shown in FIG. 1, that is, disposed in a region, in which the drive magnet 13 and the driven magnet 9 of the rotor 8 face each other. This region is such that the two magnets 9 and 13 which are magnetically coupled to each other face each other in it and that its space enlargement is restricted. Therefore, it is particularly necessary to suppress the deformation or extrusion of the barrel part 20*b* in this region. The suppression of such deformation or extrusion can be attained by positively reinforcing the barrel part 20*b* by mean of the reinforcing belt-like member 22 woundly fitted on the outer periphery of the barrel part 20*b* which constitutes a point or region that is most adversely affected by pressure and heat to result in undesired deformation or extrusion and rupture in the extreme rear casing 5. The casing cover member 21 thus may be formed by using a thermoplastic resin which is weakly resistant to heat, because even in this case it can sufficiently provide the cover function in cooperation with the assistant force of the belt-like ring member 22.

Figure 3:
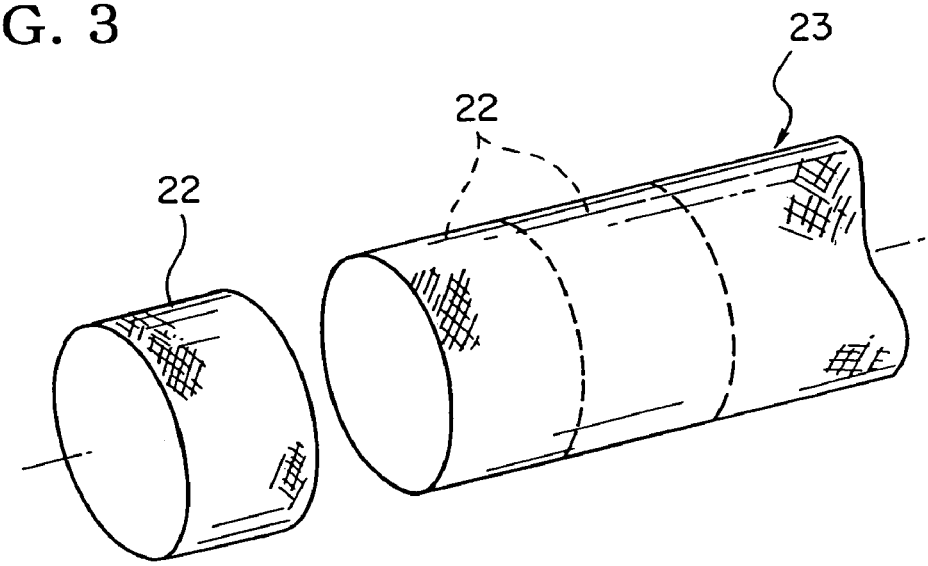
FIG. 3 is a perspective view showing the manner of fabrication of the reinforcing belt-like ring member shown in FIG. 2.

The belt-like ring member 22, as shown in FIG. 3, can be readily fabricated by slicing a cylindrical work member 23 to a desired width, and it is possible to use as the work material which is difficult to be processed to a complicated shape. Also, the material is commercially available.

Also, since disassembling from the state with the rear casing 5 assembled as shown in FIG. 1 to the state as shown in FIG. 2 can be readily made, the assembling and parts replacing operations can be readily made.

In the above description of the first embodiment of the rear casing according to the invention, various examples of the materials of the individual parts have been shown. While the inner casing member 20 constituting the rear casing 5 and the cover member 21 overlapped over the outer side of the inner casing member 20 are formed from materials constituted by synthetic resin as a base, in the broad sense of the subject matter of the invention the kinds of the synthetic resin are not particularly limited. Likewise, the material of the belt-like ring member 22 is not particularly limited. Furthermore, in a broad sense the belt-like ring member 22 according to the present invention is also applicable to a rear casing, in which both the members 20 and 21 are formed from materials other than the synthetic resin.

In the first embodiment of the present invention, the rear casing 5 as shown is constituted by two layers of inner and outer casing members 20 and 21, and the belt-like ring member 22 is fitted on the outer periphery of the barrel part 20*b* of the inner casing members 20. However, it is also possible to put the belt-like ring member 22 on the outer periphery of the barrel part 21*b* of the outer casing member 21.

Figure 4:
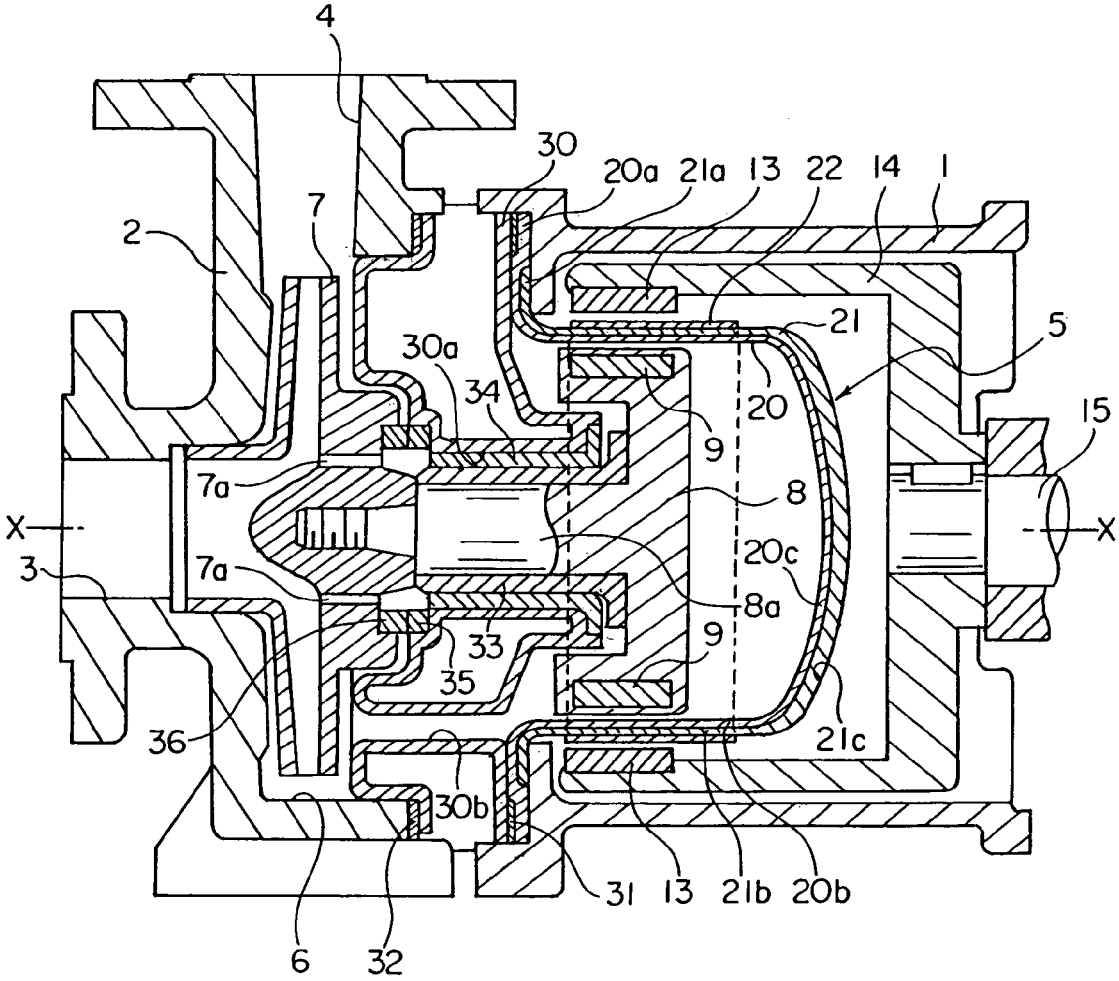
FIG. 4 is a sectional view showing a magnetic drive pump having a second embodiment of the rear casing structure according to the invention.

Further, the rear casing arrangement of the present invention is also applicable to a magnetic drive pump which has a split member serving the same function as the spindle 10 as the rotation support means which is supported by the front side support 12 and the rear side support part 20*d* described in the first embodiment of the present invention and is shown in FIG. 4.

FIG. 4 shows the construction of a magnetic drive pump with a rear casing as a second embodiment of the present invention. In the Figure, parts like those in the first embodiment are designated by like reference numerals and symbols, and are not specifically described.

In FIG. 4, designated at 30 is a split member having an inner bore 30*a* extending in the longitudinal axis X—X. The split member 30 is interposed between the pump member 1 and the front casing 2, and is assembled in a sealed state in the pump body 1 and the front casing 2 via seal members 31 and 32, respectively, such as O-rings and gaskets. In the description of this embodiment, the split member 30 constitutes part of the front casing 2.

The rotor 8 has a shaft part 8*a* extending in the longitudinal axis X—X. The shaft part 8*a* has its front end part screwedly secured to the impeller 7 and rotatably supported via a sleeve 33 and a bearing 34 in the inner bore 30*a* of the split member 30. The rotor 8 is thus rotated in unison with the impeller 7 with the split member 30 as a rotational support means. The pump supply fluid in the pump chamber 6, in which the impeller 7 is accommodated, experiences higher pressure inside the rear casing due to pressure generated with the rotation of the impeller 7, and penetrates from the higher pressure rear casing 6 to the side of the intake port 3 of the impeller 7 which is lower in pressure. The pump supply fluid penetrates a route that it first flows through a thorough bore 30*b* which is provided in the split member 30 into the rear casing 6 and thence through the bearing 34 and the sleeve 33 and also through a thorough bore 7*a* formed in the impeller 7 to the side of the intake port 3 of the impeller 7.

As for the movement of the rotor 8 in the directions of the longitudinal axis X—X, the rearward movement is restricted by the engagement of thrust bearings 35 and 36 of the split member 30 and the impeller 7, respectively, with each other, while the forward movement is restricted by the engagement of bent rear end parts of the sleeve 33 and the bearing 34, respectively, with each other.

As for its laminar structure, the rear casing 5 has a two-layer structure as in the first embodiment, that is, it is constituted by the inner casing member 20 and the casing cover member 21 detachably overlapped over the outer periphery of the inner casing member 20. The members 20 and 21 constitute the rear casing 5 and are respectively one-piece members having flange parts 20*a* and 21*a*, which are each mounted via a seal member 31 or 32 such as an O-ring or a gasket on the split member 30 constituting part of the front casing 2 and held in a state sandwiched between the split member 30 and the pump body 1, cylindrical barrel parts 20*b* and 21*b* each intervening between the drive magnet 13 and the rotor 8, and rear end parts 20*c* and 21*c* each integral with the rear end of the associated barrel part. The materials of the members 20 and 21 are like those described before in connection with the first embodiment.

The rear casing 5 is set apart from the rear casing 5 in the previous first embodiment in that the rear end part 20*c* of the inner casing member 20, unlike the first embodiment, does not have any part for supporting the rear end of the spindle 10.

In the magnetic drive pump of the above structure, as shown in FIG. 4, the belt-like ring member 22 according to the present invention is fitted on the outer periphery of the barrel part of the rear casing 5, i.e., the outer periphery of the barrel part 21*b* of the rear casing cover 21. The belt-like ring member 22 has a width smaller than the length of the barrel part 21*b*, and also smaller than the length of the barrel part 20*b* of the inner casing member 20. The length of the barrel part 21*b* is counted along the longitudinal axis X—X of the pump body 1 or the magnetic drive pump. The belt-like ring member 22 is disposed in a region, in which the two magnets 13 and 9 radially face each other, and substantially at a central part of the barrel part of the rear casing. The belt-like ring member 22 is formed from a material like what has been described in connection with the first embodiment. The belt-like ring member 22 provided on the barrel part reinforces the barrel part and positively prevents deformation or extrusion of the rear casing 5, particularly the barrel part thereof which has high possibility of rupture due to pressure and heat from the pump supply fluid during the pump operation, thus sufficiently providing the desired functions of the rear casing.

In the second embodiment, like the first embodiment, it is possible to dispose the belt-like ring member 22 between the inner casing member 20 and the casing cover member 21.

Further, while in the second embodiment, like the first embodiment, the ring member 22 is provided to a two-layer structure constituted by two separable members, i.e., the inner casing member 20 and the casing cover member 21, in the case of a rear casing of a single layer or single member structure, the ring member 22 may also be provided on the outer periphery of the barrel part, thus providing a desired reinforcing effect. The present invention thus covers a single member structure rear casing as well.

While the present invention has been described in connection with the preferred embodiments thereof, these embodiments are by no means limitative, and various changes and modifications are possible in the structure of the magnetic drive pump and the structure of the rear casing as the basis of the magnetic drive pump. Particularly, the dimensions such as the width and the material of the reinforcing belt-like ring member 22 described before in connection with the embodiments are by no means limitative to those in the above embodiments but can be set as desired in the mechanical strength design of the entire rear casing as desired.

As has been described in the foregoing, in the rear casing arrangement according to the present invention a sufficient reinforcing effect is obtainable by fitting the reinforcing belt-like ring member on the outer periphery of the rear casing barrel part, which is weakest in the mechanical strength. Besides, since the belt-like ring member can be of simple shape, it is possible to select a material, which difficultly permits processing to a complicated shape. For example, the rear casing thus can be formed by selecting a synthetic resin as its material, which permits fabrication by injection molding, and thus it is possible to provide a rear casing, which can be manufactured at low cost as a whole and is strong not only with respect to corrosion but also to pressure and heat.

What is claimed is:

1. A rear casing arrangement for a magnetic drive pump, said magnetic drive pump comprising:

a front casing having an intake port directed in the longitudinal axis direction and a discharge port directed in the radial direction, a rear casing defining an inner pump chamber in cooperation with the front casing, an impeller disposed in the pump chamber, a rotor for being rotated in unison with the impeller and having a driven magnet, rotor support means for rotatably supporting the rotor, and a drive magnet disposed on the outside of the rear casing such as to face the driven magnet on the rotor via the rear casing and magnetically coupled to the driven magnet for causing rotation of the rotor in unison with the impeller, whereby a pump supply fluid such as a chemical fluid or a semiconductor processing fluid is caused to flow into the pump chamber from the intake port and out of the pump chamber from the discharge part for execution of the pump operation, said rear casing including:

a flange part mounted on the front casing, a cylindrical barrel part interposed between the rotor and the drive magnet, said barrel part having a front end integral with the flange part and a rear end, and a rear end part integral with the rear end of the barrel part and having a closed rear end, said rear casing having a reinforcing belt-like ring member woundly fitted on the outer periphery of a cylindrical barrel part of the rear casing, said ring member having a width smaller than the length of the cylindrical barrel part of the rear casing.

2. The rear casing arrangement for the magnetic drive pump according to claim 1, wherein said rear casing is formed from a synthetic resin, and the reinforcing belt-like ring member is formed from a material constituted by a combination of a thermoplastic resin and fibrous reinforcing material.

3. The rear casing arrangement for the magnetic drive pump according to claim 1, wherein said reinforcing belt-like ring member is disposed in a region, in which the drive magnet and the driven magnet of the rotor face each other.

4. A rear casing arrangement for a magnetic drive pump, said magnetic drive pump comprising:

a front casing having an intake port directed in the longitudinal axis direction and a discharge port directed in the radial direction, a rear casing defining an inner pump chamber in cooperation with the front casing, an impeller disposed in the pump chamber, a rotor for being rotated in unison with the impeller and having a driven magnet, rotor support means for rotatably supporting the rotor, and a drive magnet disposed on the outside of the rear casing such as to face the driven magnet on the rotor via the rear casing and magnetically coupled to the driven magnet for causing rotation of the rotor in unison with the impeller, whereby a pump supply fluid such as a chemical fluid or a semiconductor processing fluid is caused to flow into the pump chamber from the intake port and out of the pump chamber from the discharge port for execution of the pump operation, said rear casing including:

an inner casing member having a flange part mounted on the front casing, a cylindrical barrel part interposed between the rotor and the drive magnet, said barrel part having a front end integral with the flange part and a rear end, and a rear end part integral with the rear end of the barrel part and having a closed rear end, said inner casing member being to be in direct contact with the pump supply fluid in the pump chamber, and a casing cover member corresponding in shape to the inner casing member and having a flange part, a cylindrical barrel part and a rear end part, said casing cover member being fitted on the outer periphery of the inner casing member, said rear casing having a reinforcing belt-like ring member woundly fitted on the outer periphery of the cylindrical barrel part of the inner casing member between the inner casing member and the casing cover member, said ring member having a width smaller than the length of the cylindrical barrel part of the inner casing member.

5. The rear casing arrangement for the magnetic drive pump according to claim 4, wherein said inner casing member is formed from a thermoplastic resin, the casing cover member is formed from a thermoplastic resin or a material constituted by a combination of the thermoplastic resin and a fibrous reinforcing material, and the reinforcing belt-like ring member is formed from a material constituted by a combination of a thermoplastic resin and a fibrous reinforcing material.

6. The rear casing arrangement for the magnetic drive pump according to claim 4, wherein said reinforcing belt-like ring member is disposed in a region, in which the drive magnet and the driven magnet of the rotor face each other.

* * * * *